US006602550B1

(12) United States Patent
Grant et al.

(10) Patent No.: US 6,602,550 B1
(45) Date of Patent: Aug. 5, 2003

(54) METHOD FOR LOCALIZED SURFACE TREATMENT OF METAL COMPONENT BY DIFFUSION ALLOYING

(75) Inventors: Harley A. Grant, Harrison, TN (US); Jerry Paul Stewart, Red Bank, TN (US)

(73) Assignee: Arapahoe Holdings, LLC, Chattanooga, TN (US)

( * ) Notice: Subject to any disclaimer, the term of this patent is extended or adjusted under 35 U.S.C. 154(b) by 0 days.

(21) Appl. No.: 09/963,907

(22) Filed: Sep. 26, 2001

(51) Int. Cl.[7] ..... C23C 16/06
(52) U.S. Cl. ..... 427/252; 427/253
(58) Field of Search ..... 427/248.1, 250, 427/252, 253

(56) References Cited

U.S. PATENT DOCUMENTS

| | | | | |
|---|---|---|---|---|
| 2,825,658 A | | 3/1958 | Samuel | |
| 3,622,402 A | | 11/1971 | Baranow et al. | |
| 3,785,854 A | | 1/1974 | Baldi | |
| 3,801,357 A | | 4/1974 | Baldi | |
| 3,958,046 A | | 5/1976 | Baldi | |
| 4,096,296 A | * | 6/1978 | Galmiche et al. | 427/247 |
| 4,131,473 A | | 12/1978 | Kachik et al. | |
| 4,249,961 A | * | 2/1981 | Nevalainen | 148/14 |
| 4,290,391 A | | 9/1981 | Baldi | |
| 4,307,277 A | | 12/1981 | Maeda et al. | |
| 4,350,719 A | | 9/1982 | Baldi | |
| 4,469,532 A | | 9/1984 | Nicolas | |
| 4,485,148 A | | 11/1984 | Rashid et al. | |
| 4,694,036 A | | 9/1987 | Baldi | |
| 4,810,846 A | | 3/1989 | Holcombe et al. | |
| 4,820,362 A | | 4/1989 | Baldi | |
| 4,830,931 A | | 5/1989 | Baldi | |
| 4,880,578 A | | 11/1989 | Holcombe et al. | |
| 4,904,501 A | | 2/1990 | Davis | |
| 4,963,395 A | | 10/1990 | Lewis et al. | |
| 4,963,709 A | | 10/1990 | Kimrey, Jr. | |
| 4,993,359 A | | 2/1991 | Lewis et al. | |
| 5,041,309 A | | 8/1991 | Davis et al. | |
| 5,107,798 A | | 4/1992 | Gerep | |
| 5,135,777 A | | 8/1992 | Davis et al. | |
| 5,194,219 A | | 3/1993 | Baldi | |
| 5,202,541 A | | 4/1993 | Patterson et al. | |
| 5,208,071 A | | 5/1993 | Davis et al. | |

(List continued on next page.)

*Primary Examiner*—Bret Chen
(74) *Attorney, Agent, or Firm*—Chambliss, Bahner & Stophel, P.C.

(57) ABSTRACT

A method for treating a portion of a metal component by diffusion alloying includes providing a container having at least one open end. The container has a width that is greater than the width of the portion of the metal component to be treated, a thickness that is greater than the thickness of the portion of the metal component to be treated, and a depth that is greater than the length of the portion of the metal component to be treated. According to the method, the portion of the metal component to be treated is placed in the container. A heat-activated alloying powder is placed in the container around the portion of the component to be treated in a layer that extends along the length of the portion of the component to be treated. A non-oxidizing powder is placed in the container adjacent to the alloying powder and around the metal component in a layer that extends to an open end of the container. A cap is provided for each open end of the container to seal the container around the metal component except for gases which are produced in diffusion alloying. A furnace is provided to heat the portion of the metal component to be treated to activate the alloying powder. The container is placed with the portion of the metal component to be treated therein in the furnace, and the furnace is operated to heat the portion of the metal component in the container to a temperature and for a time sufficient to cause diffusion alloying of the portion of the metal component to be treated by the alloying powder.

19 Claims, 7 Drawing Sheets

U.S. PATENT DOCUMENTS

| | | | | | |
|---|---|---|---|---|---|
| 5,230,865 | A | | 7/1993 | Hargett et al. | |
| 5,238,710 | A | | 8/1993 | Ahmad et al. | |
| 5,582,867 | A | | 12/1996 | Tsubouchi et al. | |
| 5,672,387 | A | | 9/1997 | Tsubouchi et al. | |
| 5,747,112 | A | | 5/1998 | Tsubouchi et al. | |
| 5,803,991 | A | | 9/1998 | Tsubouchi et al. | |
| 5,811,769 | A | | 9/1998 | Schiffmann et al. | |
| 5,882,439 | A | * | 3/1999 | Nakahama et al. | 148/240 |
| 5,939,144 | A | | 8/1999 | Zayets et al. | |
| 5,972,429 | A | * | 10/1999 | Bayer et al. | 427/253 |
| 6,197,436 | B1 | * | 3/2001 | Zayets et al. | 428/622 |

* cited by examiner

METHOD FOR LOCALIZED SURFACE TREATMENT OF METAL COMPONENT BY DIFFUSION ALLOYING

FIELD OF THE INVENTION

This invention relates generally to the treatment or surface modification of a metal component by diffusion alloying, in order to increase its hardness and resistance to wear by abrasion, and its corrosion-resistance. More particularly, the invention relates to such treatment or surface modification of only a portion of a metal component, such as a portion of a steel boiler tube or other elongated component.

BACKGROUND AND DESCRIPTION OF THE PRIOR ART

Chromizing is a thermally activated diffusion process that is used to produce a high chromium-content surface layer on an iron or steel surface. This process is used on boiler tubes, pipes and other metallic components of chemical recovery boilers, coal-fired utility boilers and other types of industrial equipment to provide a surface which is resistant to erosion, abrasion, oxidation and corrosion. Iron and steel components such as boiler components are often chromized by a process known as pack diffusion, wherein a pack mixture comprising chromium or ferrochromium, an inert filler such as alumina ($Al_2O_3$), and a halide activator such as ammonium chloride ($NH_4Cl$), are blended together. The component is then placed in the pack mixture in a retort having an atmosphere which is controlled so as to preclude oxidation. If it is desired to chromize only the internal surface of a boiler tube, the tube itself may be filled with the pack mixture and a cap welded into place on each end of the tube, so that the tube itself becomes a self-contained retort. The retort is then heated to an elevated temperature for a specified period of time. A typical pack diffusion thermal cycle involves holding the retort and its contents at a temperature within the range of 1800°–2000° F. for one to ten hours. This heating causes the chromium in the powder to gasify, to deposit on the boiler component and to diffuse into the base metal of the boiler component. In such diffusion process, the chromium atoms physically and metallurgically penetrate the base metal surface of the component and substitute for some of the iron atoms of the base metal. This diffusion process results in an iron or steel boiler component having an iron-chromium alloy coating that is metallurgically bonded as an integral part of the base metal of the component. Since the structural modifications to the boiler component which result from the diffusion process occur within the surface of the base metal and not on the surface itself, the diffused chromium is an integral part of the surface of the base metal which is not subject to the spalling or peeling that may characterize mechanically bonded coatings.

Similar processes may be used to diffuse other elements, such as aluminum, nickel, silicon, boron or zinc, into the surface of a metal component. Specific chromizing and other diffusion processes are described in U.S. Pat. No. 2,825,658 of Samuel, U.S. Pat. No. 3,622,402 of Baranow et al., U.S. Pat. No. 3,785,854, U.S. Pat. No. 3,801,357, U.S. Pat. No. 3,958,046, U.S. Pat. No. 4,290,391, U.S. Pat. No. 4,350,719, U.S. Pat. No. 4,694,036, U.S. Pat. No. 4,820,362, U.S. Pat. No. 4,830,931 and U.S. Pat. No. 5,194,219 of Baldi, U.S. Pat. No. 4,469,532 of Nicolas, U.S. Pat. No. 4,485,148 of Rashid et al., U.S. Pat. No. 4,904,501 and U.S. Pat. No. 5,041,309 of Davis, U.S. Pat. No. 4,963,395 and U.S. Pat. No. 4,993,359 of Lewis et al., U.S. Pat. No. 5,135,777 and U.S. Pat. No. 5,208,071 of Davis et al., and U.S. Pat. No. 5,582,867, U.S. Pat. No. 5,672,387, U.S. Pat. No. 5,747,112 and U.S. Pat. No. 5,803,991 of Tsubouchi et al.

Although these patents describe various methods for diffusing various elements into the surface of a metal component, most such methods require that the entire component be placed into a sealed retort for such treatment. Those which describe the treatment by diffusion alloying of only a part of a metal component require that the portion of the component that is not to be treated must be masked prior to placing the entire component in a retort. Care must be taken to completely mask the portion that does not require treatment and to avoid scratching such masked portion to insure that masking is effective. Since masking methods are inconvenient at best and sometimes ineffective as well, it would be desirable if a method could be developed by which a portion of a metal component could be treated by diffusion alloying without requiring masking or other special treatment of the remainder of the component.

ADVANTAGES OF THE INVENTION

Among the advantages of the invention is the fact that it permits the diffusion alloying of only a portion of a metal component without requiring that the part of the component not to be treated be masked. Another advantage of the invention is that its ease of operation and low cost renders diffusion alloying of only a portion of a component convenient, thereby avoiding the situation where entire components are treated by diffusion alloying when only a portion thereof is required to be so treated. Still another advantage of the invention is that it does not require that an inert gas atmosphere or flow be supplied in the diffusion process.

Another advantage of a preferred embodiment of the invention is that it facilitates diffusion alloying at a rate considerably more rapid than is disclosed in the prior art.

Additional objects and advantages of this invention will become apparent from an examination of the drawings and the ensuing description.

EXPLANATION OF TECHNICAL TERMS

As used herein, the term diffusion alloying refers to a thermally activated diffusion process by which a surface layer containing an alloying element is produced on a metal component.

As used herein, the term ferrous alloy refers to an alloy that is at least 50% by weight iron.

SUMMARY OF THE INVENTION

The invention comprises a method for treating a portion of a metal component by diffusion alloying. According to this method, a container with at least one open end is provided. The container also has a width that is greater than the width of the portion of the metal component to be treated and a depth that is greater than the length of the portion of the metal component to be treated. The portion of the metal component to be treated is placed in the container, and a heat-activated alloying powder is placed in the container around the portion of the component to be treated in a layer that extends along the length of the portion of the component to be treated. A non-oxidizing powder is also placed in the container adjacent to the alloying powder and around the metal component in a layer that extends to an open end of the container. A cap is provided for each open end of the container, which cap is adapted to seal the container around the metal component except for gases which are produced in diffusion alloying. A furnace that is adapted to heat the portion of the metal component to be treated to activate the alloying powder is also provided. The container with the portion of the metal component to be treated therein is placed in the furnace, and the furnace is operated to heat the portion of the metal component in the container to a temperature and for a time sufficient to cause diffusion alloying of the portion of the metal component to be treated by the alloying powder.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
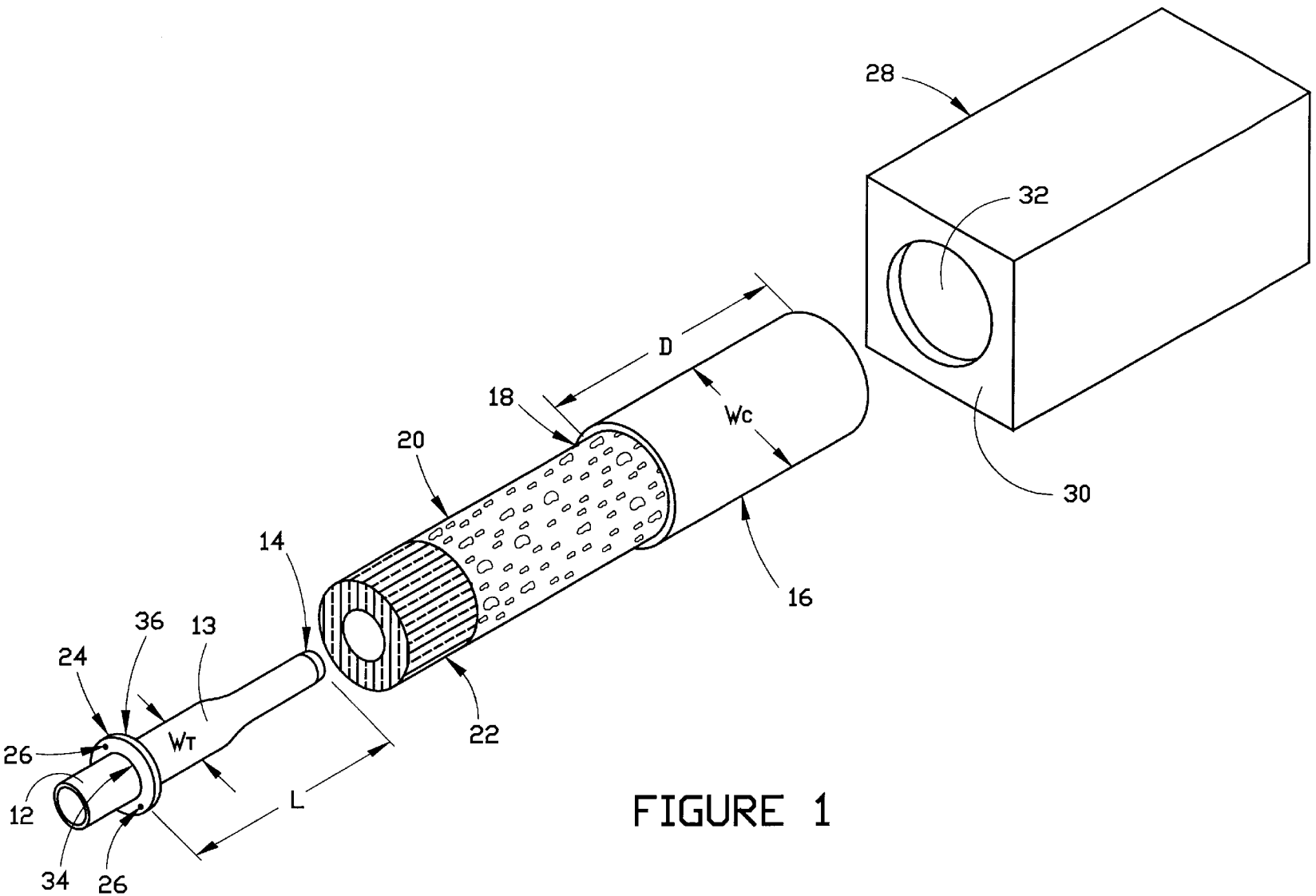
FIG. 1 is an exploded perspective view of a preferred embodiment of the apparatus that is useful in practicing the invention.
Figure 2:
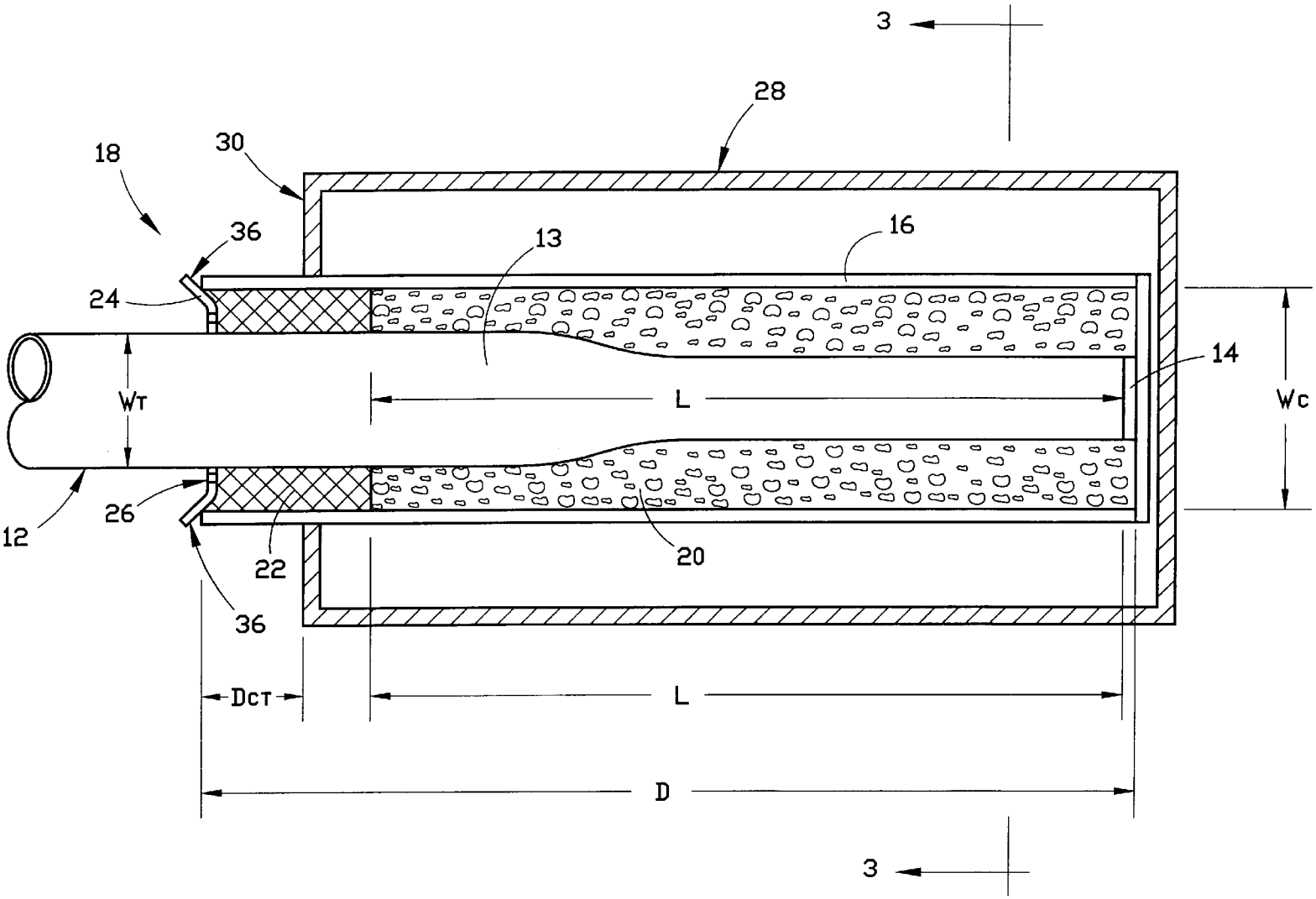
FIG. 2 is a sectional view of the apparatus of FIG. 1.
Figure 3:
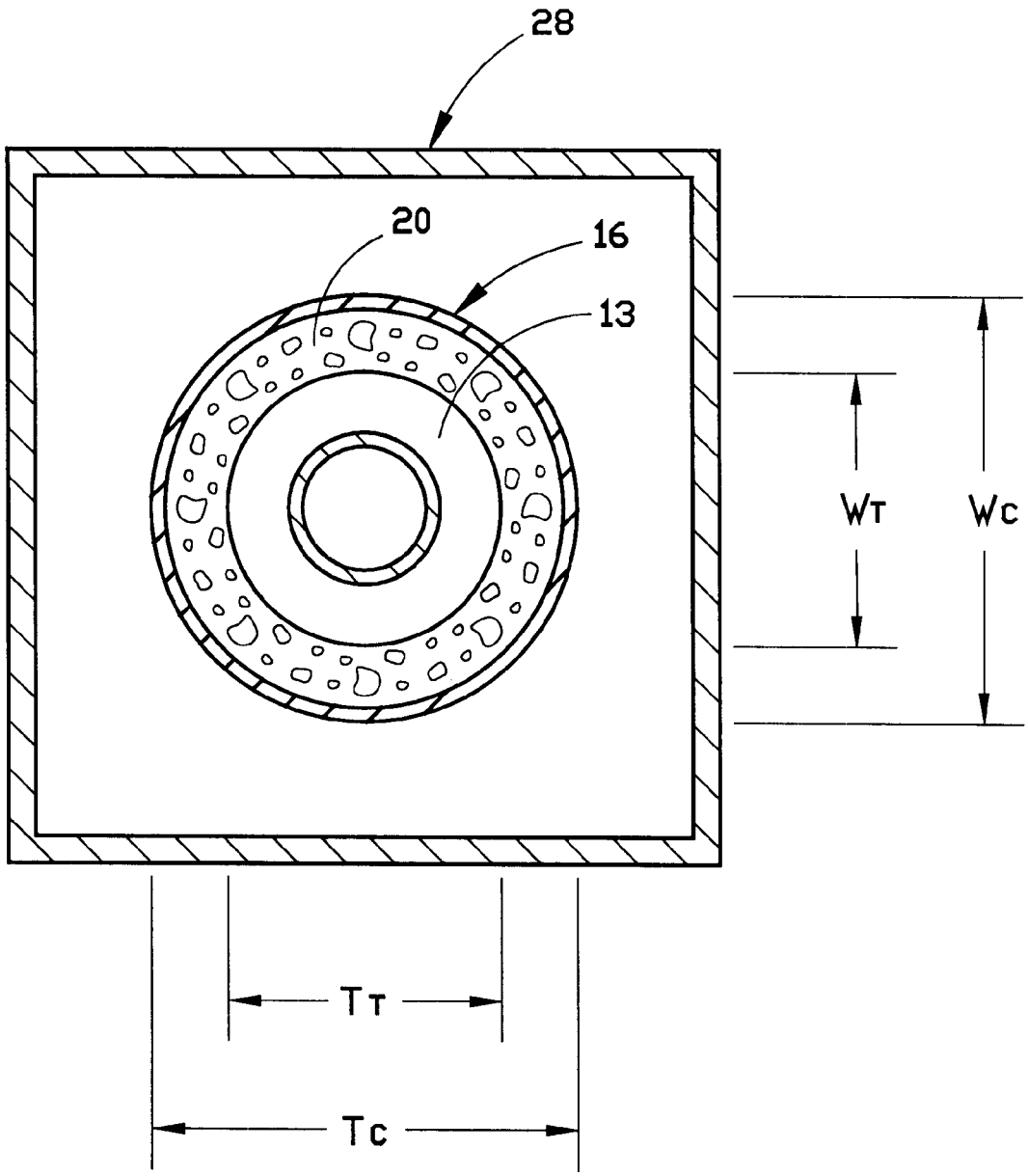
FIG. 3 is a sectional view of the apparatus of FIG. 2, taken along the line 3—3 of FIG. 2.

Referring now to FIGS. 1, 2 and 3, the preferred apparatus for use in practicing the invention may be utilized to treat by diffusion alloying a portion of a metal component such as boiler tube 12 which is typically comprised of a ferrous alloy. In this embodiment of the invention, the boiler tube may itself be of any length, but because of the conditions encountered in the boiler, it may only be necessary to chromize or otherwise treat by diffusion alloying the exterior surface of end portion 13.

In the practice of the invention, portion 13 of the boiler tube or other metal component to be treated is preferably capped at one end with end cap 14 in order to prevent the alloying powder from entering the tube. The capped end is placed in container 16, as shown in FIGS. 1, 2 and 3. Container 16 is provided having at least one open end 18. The container may be provided in any convenient shape and size so long as it has a width $W_C$ that is greater than the width $W_T$ of portion 13 of the metal component to be treated, a thickness $T_C$ that is greater than the thickness $T_T$ of the portion 13 of the metal component to be treated, and a depth D that is greater than the length L of portion 13. The particular dimensions of the container are not critical, so long as it may accommodate a quantity of heat-activated alloying powder in contact with the surfaces of the metal component to be treated. Preferred results may be obtained, however, when the container is dimensioned so as to allow for at least a one-inch thickness of heat-activated alloying powder between the exterior surface of the metal component and the interior walls of the container. The container may be comprised of metal or, in a particularly preferred embodiment of the invention, a ceramic material.

As shown in FIGS. 2 and 3, a quantity of heat-activated alloying powder 20 is placed in the container around portion 13 of the component to be treated in a layer that extends along the length L of portion 13. If the diffusion alloying desired is chromizing of a metal component such as, for example, a ferrous metal component, the metal powder component of the alloying powder will preferably comprise about 30% to about 45% by weight chromium, ferrochromium or a mixture of chromium and ferrochromium, about 45% to about 65% by weight metal oxide powder, and about 3% to about 8% by weight of a halide catalyst. If it is desired to diffuse aluminum into a metal component, the alloying powder will preferably comprise about 3% to about 20% by weight aluminum, about 75% to about 95% by weight metal oxide powder and about 3% to about 8% by weight of a halide catalyst. If it is desired to diffuse nickel, boron or vanadium into a metal component, the alloying powder will preferably comprise about 3% to about 30% by weight metal (nickel, boron or vanadium) powder, about 65% to about 95% by weight metal oxide powder and about 3% to about 8% by weight of a halide catalyst. Preferably, the metal oxide powder will comprise alumina, although it may comprise any suitable inert filler such as kaolin, MgO, $SiO_2$ or $Cr_2O_3$, and such fillers can be used singly or in any combination. The halide catalyst is an activator that greatly speeds up the diffusion process. Preferably, the halide catalyst has a formula $NH_4X$, where X is a halide. Such preferred halide catalysts may include ammonium chloride, ammonium iodide, ammonium bromide, ammonium fluoride and ammonium bifluoride. Other halide catalysts may include elemental iodine, elemental bromine, hydrogen bromide, aluminum chloride, aluminum chromide, aluminum bromide and aluminum iodide. These halide catalysts can be used individually or in any combination, and in concentrations from about 3% to about 8% by weight. It is preferred that the catalyst be provided in powder form.

The invention also includes placing a quantity of non-oxidizing powder 22 in container 16 adjacent to alloying powder 20 and around boiler tube 12 or other metal component to be treated.

The non-oxidizing powder is provided in a layer that extends to an open end (such as end 18) of the container. Preferably, the non-oxidizing powder comprises about 95% to about 97% by weight metal oxide powder, and about 3% to about 5% by weight of a halide catalyst powder. More preferably, the metal oxide powder comprises the same oxide powder as is contained in the alloying powder, and the halide catalyst comprises the same halide catalyst as is contained in the alloying powder.

All of the components of the alloying powder and the non-oxidizing powder should be of a relatively fine particle size, preferably between about 45 microns (325 mesh) and about 150 microns (100 mesh), although the diffusion process is not adversely affected by non-oxidizing powder particle sizes larger than 150 microns.

Figure 5:
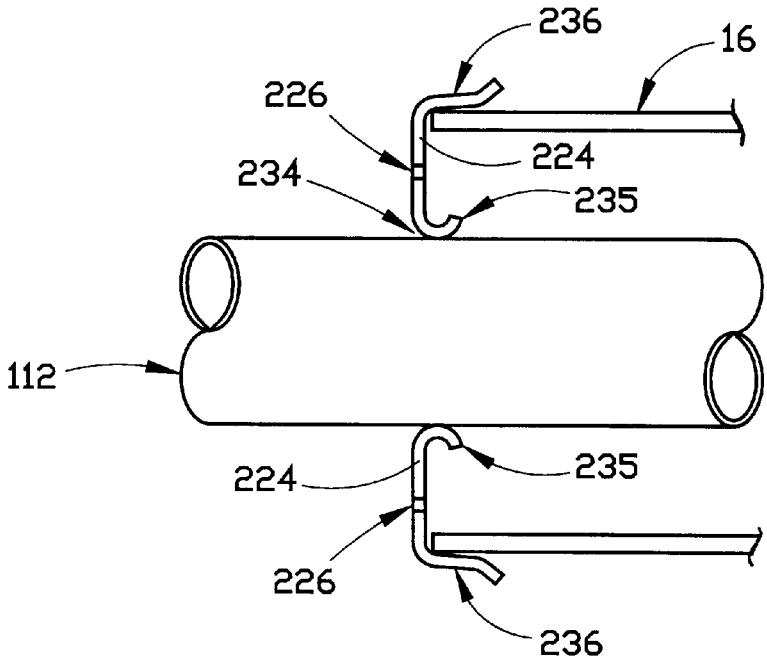
FIG. 5 is a sectional view of a portion of an embodiment of the apparatus of the invention that is similar to that of FIG. 1, illustrating another embodiment of the cap for an open end of the container.
Figure 4:
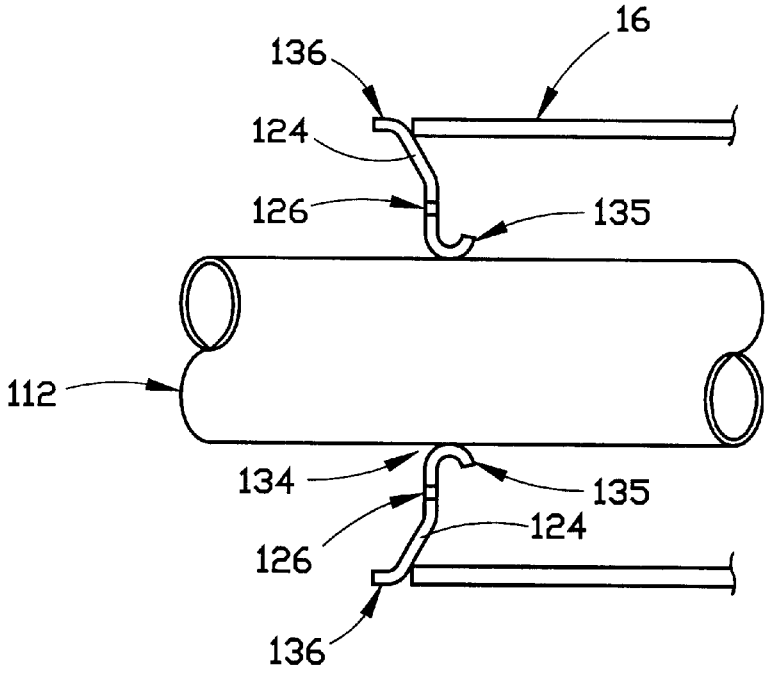
FIG. 4 is a sectional view of a portion of an embodiment of the apparatus of the invention that is similar to FIG. 1, illustrating an alternative embodiment of the cap for an open end of the container.

A cap is provided for each open end of the container to seal the container around the metal component except for gases which are produced in diffusion alloying. In one embodiment of the invention, a cap such as cap 24, comprised of the same material as container 16 may be provided. Vent holes 26 are provided in cap 24 to permit the release of the process gases during the practice of the invention. Such vent holes are provided in number and size to permit gases to pass therethrough without permitting a significant quantity of the non-oxidizing powder to pass therethrough. Preferably, such vent holes have a diameter within the range of about 0.250 inch to about 0.500 inch. Cap 24 has a central hole 34 (see FIG. 1) that is sized to fit tightly around tube 12, and peripheral flange 36 that provides a compression fit with open end 18 of container 16. Other configurations of caps are illustrated in FIGS. 4 and 5. Thus, as shown in FIG. 4, cap 124 is provided with central hole 134 that is defined by central bearing portion 135 and sized to fit tightly around tube 112, and peripheral flange 136 that provides a compression fit with open end 18 of container 16. Cap 124 is also provided with vent holes 126. Similarly, cap 224 (shown in FIG. 5) is provided with central hole 234 that is defined by central bearing portion 235 and sized to fit tightly around tube 112, and peripheral flange 236 that provides an interference fit with open end 18 of container 16. Cap 224 is also provided with vent holes 226. In the alternative, a cap comprised of a plug of ceramic fiber insulation such as the CER-WOOL® brand of such material, or other similar fibrous, gas-permeable material may be packed in the end of the container on top of the non-oxidizing powder. Any cap may be used that is adapted to seal the container around the metal component to be treated except for gases which are produced in the diffusion alloying process.

The apparatus of the invention also includes furnace 28 that is adapted to heat portion 13 of boiler tube 12 or other metal component to be treated to activate alloying powder 20. The furnace may be powered by electricity, natural gas or other power source known to those having ordinary skill in the art to which the invention relates. Preferably, the furnace is provided with a front face 30 having an opening 32 that is sized to permit the container to be placed within the furnace. The furnace may also be provided with suitable supports as are known to those having ordinary skill in the art to which the invention relates (not shown) to support the container within the furnace. Because the metal component to be treated according to the invention is enclosed in container 16, it is not necessary that a non-oxidizing or otherwise inert gas be provided in furnace 28. Furthermore, it is not necessary that opening 32 in the front face of the furnace be sealed around container 16. In fact, the front face may be omitted from the furnace, although such construction would not be as safe or provide for as efficient a use of energy as the preferred embodiment illustrated in the drawings. In a particularly preferred embodiment of the invention, the container and each cap for the container are made of ceramic material, and the furnace comprises a microwave generator. In the practice of this particularly preferred embodiment, the microwaves created by the furnace will heat the alloying powder to the desired temperature, but will not significantly heat the non-oxidizing powder, the container, the caps and the metal component.

In the practice of the invention, the container with the portion of the metal component to be treated therein is placed in furnace 28. Preferably, as shown in FIG. 2, container 16 is placed in furnace 28 so that the capped open end 18 of the container extends out of the furnace a distance $D_{CT}$ that is selected to prevent that portion of the tube 12 that extends out of the capped end of the container from reaching a predetermined critical temperature when the furnace is operated to treat the portion 13 of the tube in the container therein. Depending on the type of material of which the metal component to be treated is comprised, the critical temperature is selected so as to avoid subjecting the untreated portion of the metal component that is not protected by the non-oxidizing powder layer to undesirable heating effects which may be caused by proximity to the heat of the furnace or by conduction along the tube. When metal tube 12 is comprised of carbon steel or stainless steel, the critical temperature is about 300° F., and when the preferred alloying powders and non-oxidizing powders of the invention are employed, the corresponding distance $D_{CT}$ is within the range of about 4 to about 12 inches.

When the container has been placed in the furnace, the furnace is operated to heat the portion of the metal component in the container to a temperature and for a time sufficient to cause diffusion alloying of the portion of the metal component to be treated by the alloying powder. When a convection furnace is used to treat boiler tube components according to the invention, it is preferred that the components be heated at a rate of about 100° F. to about 150° F. per hour for a period within the range of about 15 to about 18 hours to a temperature within the range of about 1800° F. to about 2150° F. When a microwave generator is employed as the furnace, the preferred treatment temperature range is the same as for heating using a convection-type furnace, but the heating rate will preferably be within the range of about 100° F. to about 150° F. per minute and the heating period will preferably be within the range of about one to about two hours.

Figure 7:
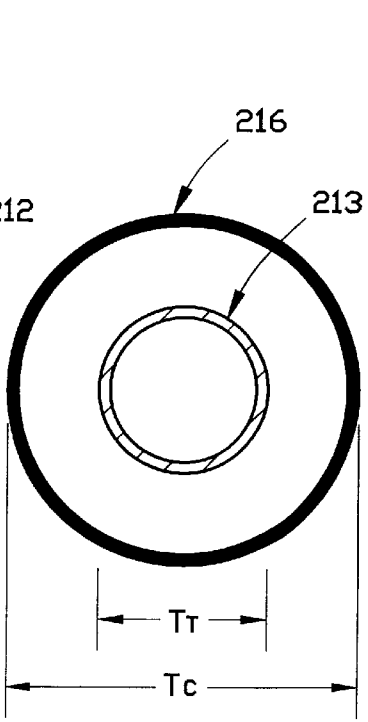
FIG. 7 is a sectional view of the apparatus of FIG. 6, taken along the line 7—7 of FIG. 6.
Figure 6:
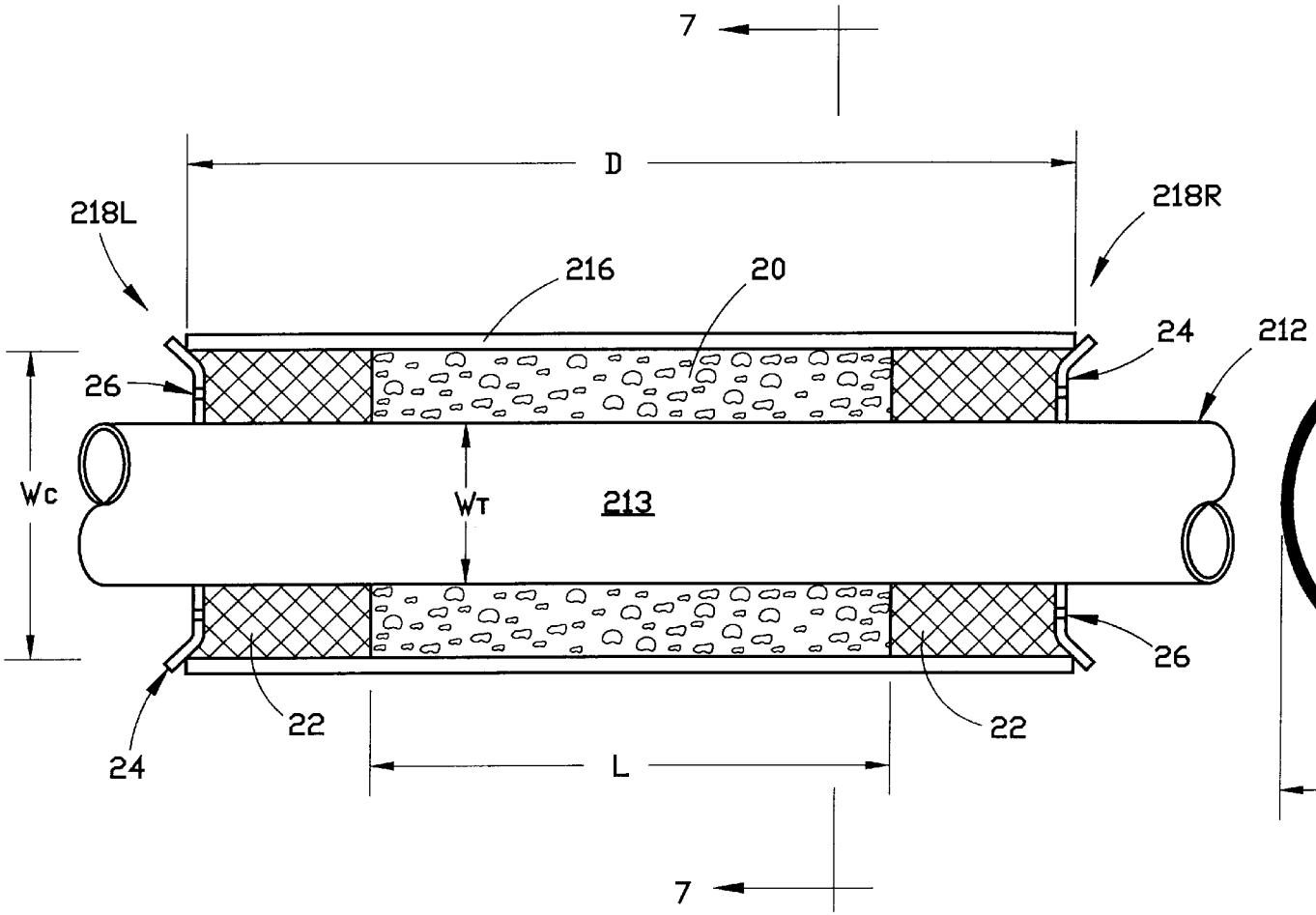
FIG. 6 is a sectional view of another embodiment of the apparatus of the invention.

The invention may also be utilized to treat an intermediate portion of a metal component such as portion 213 of boiler tube 212 of FIG. 5. As shown in FIGS. 6 and 7, intermediate tube portion 213 is placed in container 216, which is capped at each open end $\mathbf{218}_L$ and $\mathbf{218}_R$ with caps 24, each of which is provided with vents 26. The container has a width $W_C$ that is greater than the width $W_T$ of portion 213 of the metal component to be treated, a thickness $T_C$ that is greater than the thickness $T_T$ of the portion 213 of the metal component to be treated, and a depth D that is greater than the length L of portion 213. A quantity of heat-activated alloying powder 20 is placed in the container around portion 213 of the component to be treated in a layer that extends along the length L of portion 213. A quantity of non-oxidizing powder 22 is placed in the container adjacent to the alloying powder and around the metal component 212 in a layer that extends from the end of the quantity of alloying powder 20 to each open end of the container. The container with the portion of the metal component to be treated therein is then placed in a furnace (not shown) so that each capped end of the container extends out of the furnace a distance that is selected to prevent a portion of the metal component that extends out of the capped end of the container from reaching a predetermined critical temperature when the furnace is operated to heat the portion of the container therein. In this embodiment of the invention, it is preferred that the furnace be provided with a pair of oppositely disposed faces similar to front face 30 of furnace 28 to permit a portion of each end of the container containing non-oxidizing powder 22 to extend therefrom.

Figure 9:
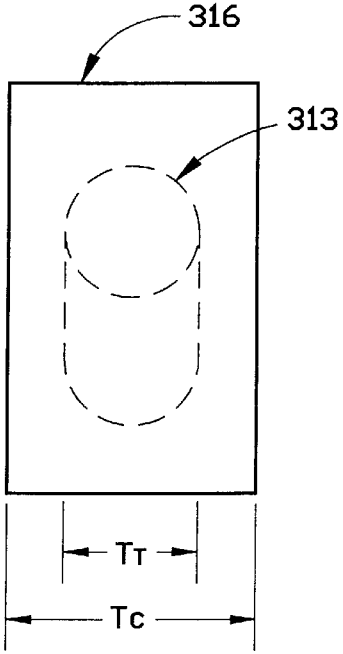
FIG. 9 is an end view of the apparatus of FIG. 8, taken along the line 9—9 of FIG. 8.
Figure 8:
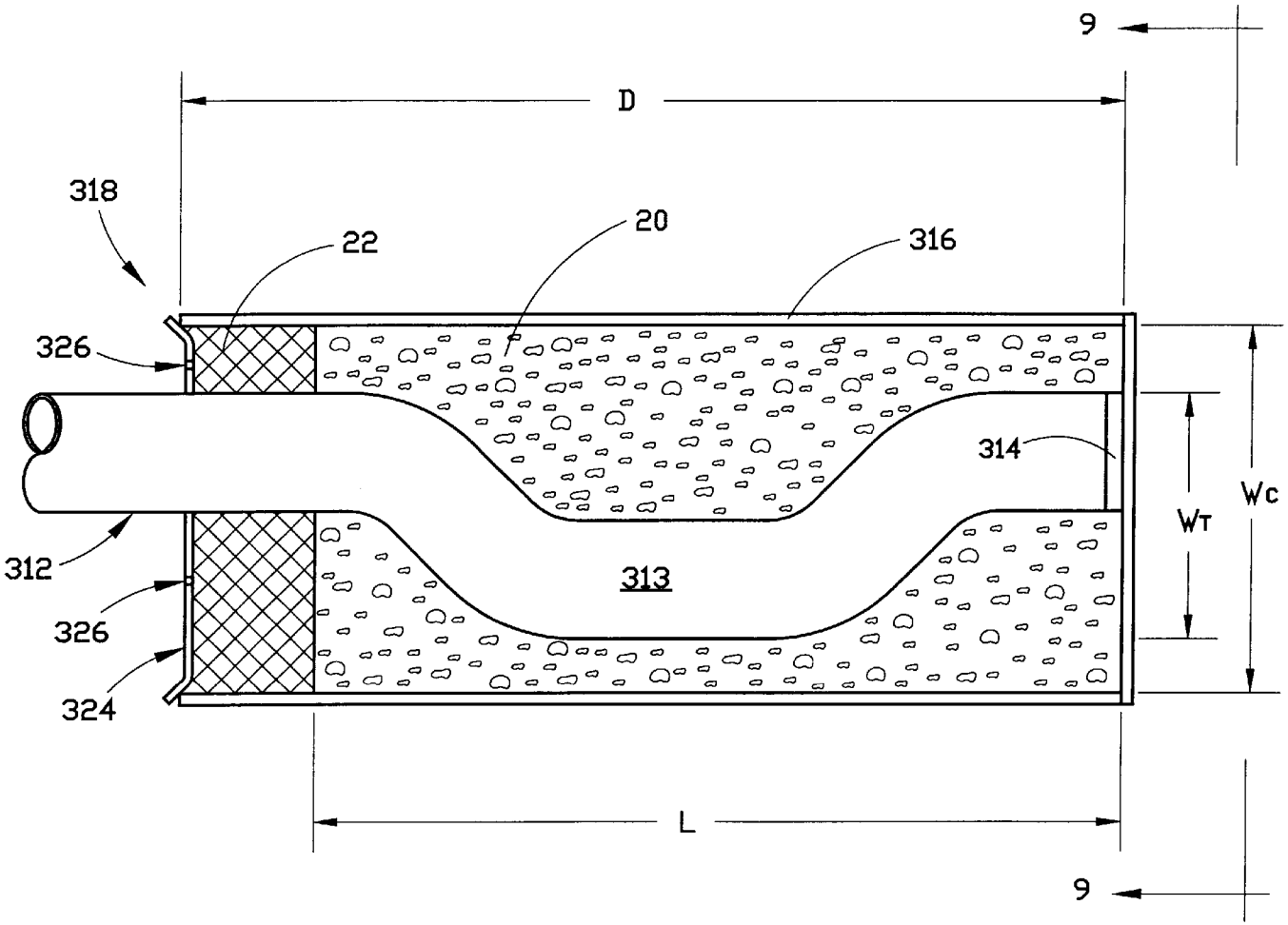
FIG. 8 is a sectional view of another embodiment of the apparatus of the invention.

The invention may also be utilized to treat portion of a metal components having various shapes and configurations. Thus, as shown in FIGS. 8 and 9, intermediate tube portion 313, fitted with end cap 314 is placed in container 316, which, because of the shape of the tube portion to be treated, is provided with a rectangular cross-section. Container 316 is capped at open end 318 with cap 324 having vent openings 326. Container 316 has a width $W_C$ that is greater than the width $W_T$ of portion 313 of the metal component to be treated, a thickness $T_C$ that is greater than the thickness $T_T$ of the portion 313 of the metal component to be treated, and a depth D that is greater than the length L of portion 313. A quantity of heat-activated alloying powder 20 is placed in the container around portion 313 of the component to be treated in a layer that extends along the length L of portion 313. A quantity of non-oxidizing powder 22 is placed in the container adjacent to the alloying powder and around the metal component 312 in a layer that extends from the end of the quantity of alloying powder 20 to the open end of the container. The container with the portion of the metal component to be treated therein is then placed in a furnace (not shown) so that the capped end of the container extends out of the furnace a distance that is selected to prevent a portion of the metal component that extends out of the capped end of the container from reaching a predetermined critical temperature when the furnace is operated to heat the portion of the container therein.

Figure 11:
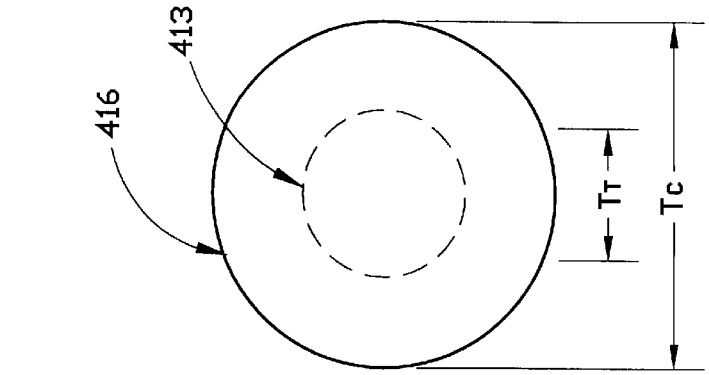
FIG. 11 is an end view of the apparatus of FIG. 10, taken along the line 11—11 of FIG. 10.
Figure 10:
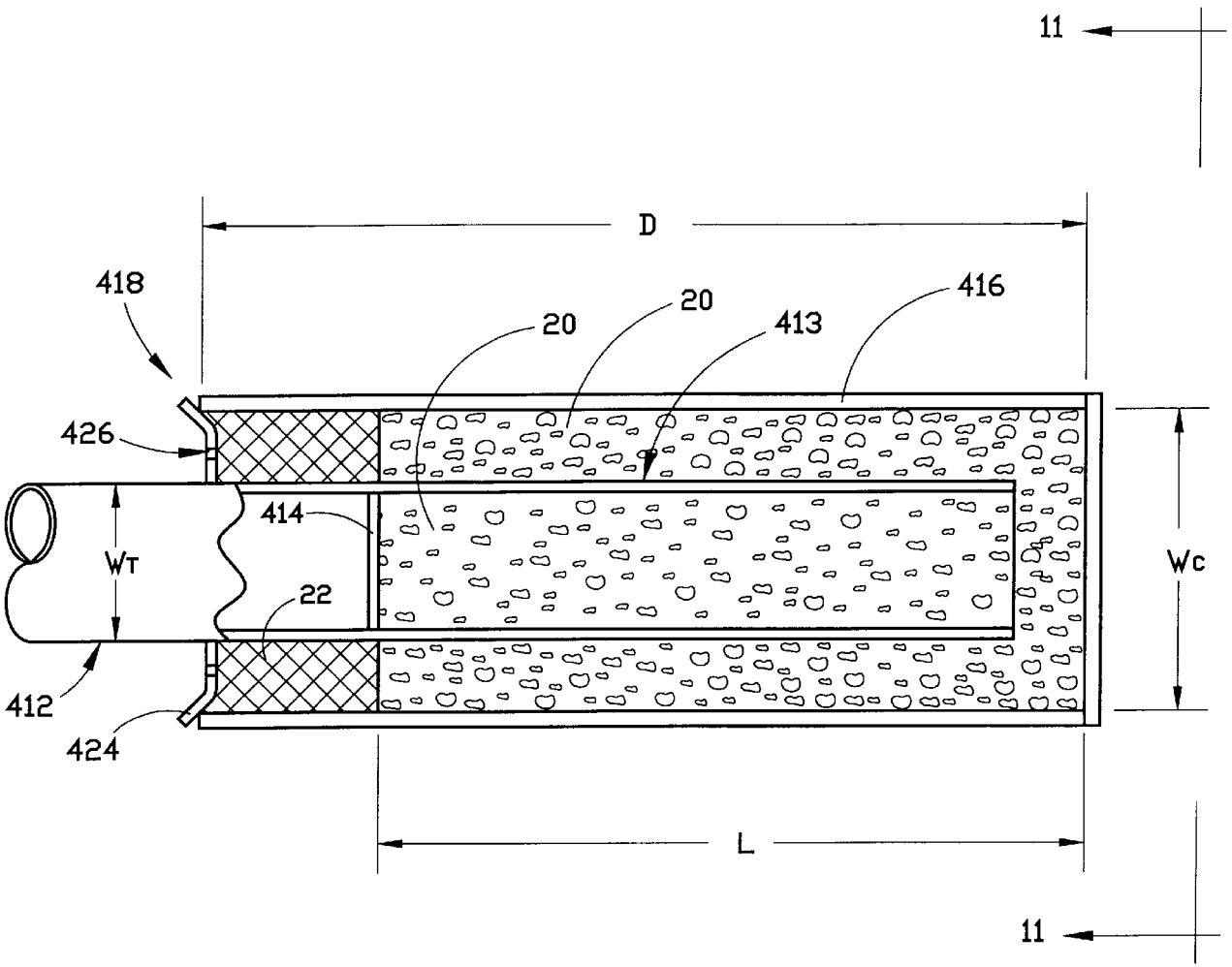
FIG. 10 is a sectional view of another embodiment of the apparatus of the invention.

The invention may also be used to simultaneously treat the internal surface and the external surface of a tube component, as shown in FIGS. 10 and 11. Portion 413 of tube 412 (shown partially cut away to illustrate the interior thereof) is preferably provided with temporary plug 414 to contain the alloying powder and to insure that it contacts the interior surface of tube portion 413. Tube portion 413 is then placed in container 416, which is capped at open end 418 with cap 424 having vent openings 426. Container 416 has a width $W_C$ that is greater than the width $W_T$ of portion 413 of the metal component to be treated, a thickness $T_C$ that is greater than the thickness $T_T$ of the portion 413 of the metal component to be treated, and a depth D that is greater than the length L of portion 413. A quantity of heat-activated alloying powder 20 is placed in the container around and within portion 413 of the component to be treated in a layer that extends along the length L of portion 413. A quantity of non-oxidizing powder 22 is placed in the container adjacent to the alloying powder and around the metal component 412 in a layer that extends from the end of the quantity of alloying powder 20 to the open end of the container. The container with the portion of the metal component to be treated therein is then placed in a furnace (not shown) so that the capped end of the container extends out of the furnace a distance that is selected to prevent a portion of the metal component that extends out of the capped end of the container from reaching a predetermined critical temperature when the furnace is operated to heat the portion of the container therein.

The invention may be used to treat metallic components of various types. It is particularly useful for diffusion alloying of chromium and aluminum onto components of cast iron, stainless steel, carbon steel and other ferrous metals, or onto components comprised of nickel-based or cobalt-based alloys. Although not shown in the drawings, the invention may be used to treat solid components as well as hollow components. In such case, no end cap such as end cap 14 is required. Otherwise, the invention may be practiced in the manner described herein.

The practice of the invention may be illustrated by reference to the following examples:

EXAMPLE 1

The invention was used to treat by diffusion alloying a six-inch portion of the exterior surface of a boiler tube having an outside diameter of 3 inches, similar to end 13 of boiler tube 12 that is illustrated in FIGS. 1, 2 and 3. The end of the boiler tube to be treated was capped with a metal cap similar to end cap 14 in order to prevent the alloying powder from entering the tube. A quantity of heat-activated alloying powder comprising about 42% by weight elemental chromium powder, about 55% by weight metal alumina powder, and about 3% by weight of $NH_4Cl$ was placed in a cylindrical container made of stainless steel and having an inside diameter of 5 inches and a length of 30 inches that is similar to container 16 of FIGS. 1, 2 and 3. The capped end of the boiler tube was placed in the center of the container, and additional alloying powder was added so that the layer of alloying powder extended six inches from the end of the boiler tube. The remainder of the container was filled with a mixture of 97% by weight alumina and 3% by weight $NH_4Cl$. CER-WOOL® ceramic fiber insulation was packed around the boiler tube to cap the container to seal it except for gases which are produced in diffusion alloying. The capped container with the end of the boiler tube therein was placed in an electric convection-type furnace similar to furnace 28 of FIGS. 1, 2 and 3. The furnace was provided with a front face having an opening that is sized to permit the container to be placed within the furnace. The container was placed in the furnace so that the capped open end of the container extended out of the furnace a distance of 12 inches. This distance is sufficient to prevent that portion of the tube that extends out of the capped end of the container from reaching a critical temperature of about 300° F. when the furnace was operated to treat the portion of the tube in the container therein. When the container was placed in the furnace, the furnace was operated for about 16 hours to heat the portion of the metal component in the container at a rate of about 125°/hour to a temperature within the range of about 1900°–2150° F. This treatment temperature was maintained for about one hour to cause diffusion alloying of the portion of the metal component to be treated by the alloying powder. The result of this process was a boiler tube that was fully chromized along the terminal six inches of its length.

EXAMPLE 2

The invention was used to treat by diffusion alloying an intermediate six-inch portion of the exterior surface of a boiler tube having an outside diameter of 3 inches, similar to intermediate portion 213 of boiler tube 212 that is illustrated in FIGS. 6 and 7. The intermediate portion of the tube was placed in a tubular container made of stainless steel and having an inside diameter of 5 inches and a length of 30 inches that is similar to container 216 of FIGS. 6 and 7. CER-WOOL® ceramic fiber insulation was packed around one end of the boiler tube and a mixture of 97% by weight alumina and 3% by weight $NH_4Cl$ was placed around the boiler tube adjacent to the closed end of the tubular container. A quantity of heat-activated alloying powder comprising about 42% by weight elemental chromium powder, about 55% by weight metal alumina powder, and about 3% by weight of $NH_4Cl$ was placed in the container adjacent to the portion of the boiler tube to be treated, and additional non-oxidizing powder was added to the open end of the tubular container. CER-WOOL® ceramic fiber insulation was then packed around the boiler tube protruding from the open end of the tubular container to cap the container to seal it except for gases which are produced in diffusion alloying. The capped container with the intermediate portion of the boiler tube therein was placed in an electric convection-type furnace similar to furnace 28 of FIGS. 1, 2 and 3. The furnace was provided with a pair of opposing faces having openings that are sized to permit the container with the boiler tube protruding therefrom to be placed within the furnace. The container was placed in the furnace so that the capped open ends of the container extended out of the furnace a distance of 12 inches. This distance is sufficient to prevent that portion of the tube that extends out of the capped end of the container from reaching a critical temperature of about 300° F. when the furnace was operated to treat the portion of the tube in the container therein. When the container was placed in the furnace, the furnace was operated for about 16 hours to heat the portion of the metal component in the container at a rate of 125°/hour to a temperature within the range of about 1900°–2150° F. This temperature was maintained for about one hour to cause diffusion alloying of the portion of the metal component to be treated by the alloying powder. The result of this process was a boiler tube that was fully chromized along an intermediate six-inch portion of its length.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. A method for treating a portion of a metal component having a width, a thickness and a length by diffusion alloying, which method comprises:

(a) providing a container having:
  (i) at least one open end;
  (ii) a width that is greater than the width of the portion of the metal component to be treated;
  (iii) a thickness that is greater than the thickness of the portion of the metal component to be treated; and
  (iv) a depth that is greater than the length of the portion of the metal component to be treated;

(b) placing the portion of the metal component to be treated in the container while allowing a portion of the metal component that is not to be treated to protrude from the container;

(c) placing a heat-activated alloying powder in the container around the portion of the component to be treated in a layer that extends along the length of the portion of the component to be treated;

(d) placing a non-oxidizing powder in the container adjacent to the alloying powder and around the metal component in a layer that extends to an open end of the container;

(e) providing a cap for each open end of the container, which cap is adapted to seal the container around the metal component except for gases which are produced in diffusion alloying;

(f) providing a furnace that is adapted to heat the portion of the metal component to be treated to activate the alloying powder;

(g) placing the container with the portion of the metal component to be treated therein in the furnace;

(h) operating the furnace to heat the portion of the metal component in the container to a temperature and for a time sufficient to cause diffusion alloying of the portion of the metal component to be treated by the alloying powder.

2. The method of claim 1 which includes the following steps instead of the corresponding steps of claim 1:

(f) providing a furnace that is adapted to receive a portion of the container that includes the portion of the metal component to be treated;

(g) placing a portion of the container with the portion of the metal component to be treated therein in the furnace so that each capped end of the container extends out of the furnace a distance that is selected to prevent a portion of the metal component that extends out of the capped end of the container from reaching a predetermined critical temperature when the furnace is operated to heat the portion of the container therein;

(h) operating the furnace to heat the portion of the container therein to a temperature and for a time sufficient to cause diffusion alloying of the portion of the metal component to be treated by the alloying powder.

3. The method of claim 2 wherein the predetermined critical temperature is about 300° F. and the distance that is selected to prevent a portion of the metal component that extends out of the capped end of the container from reaching said critical temperature is within the range of about 4 to about 12 inches.

4. The method of claim 1 which includes providing an alloying powder comprising about 30% to about 45% by weight chromium, ferrochromium or a mixture of chromium and ferrochromium, about 45% to about 65% by weight metal oxide powder, and about 3% to about 8% by weight of a halide catalyst.

5. The method of claim 1 which includes providing an alloying powder comprising about 3% to about 20% by weight aluminum, about 75% to about 95% by weight metal oxide powder, and about 3% to about 8% by weight of a halide catalyst.

6. The method of claim 1 which includes providing an alloying powder comprising about 3% to about 30% by weight nickel, boron or vanadium, about 65% to about 95% by weight metal oxide powder, and about 3% to about 8% by weight of a halide catalyst.

7. The method of claim 6 wherein the metal oxide powder comprises alumina.

8. The method of claim 6 herein the halide catalyst comprises $NH_4Cl$ powder.

9. The method of claim 1 which includes providing an alloying powder comprising about 40% to about 45% by weight chromium, ferrochromium or a mixture of chromium and ferrochromium, about 52% to about 57% by weight metal oxide powder, and about 3% to about 5% by weight of a halide catalyst.

10. The method of claim 1 which includes providing a non-oxidizing powder comprising about 95% to about 97% by weight metal oxide powder, and about 3% to about 5% by weight of a halide catalyst powder.

11. The method of claim 10 wherein the metal oxide powder comprises alumina.

12. The method of claim 10 wherein the halide catalyst powder comprises $NH_4Cl$.

13. The method of claim 1 wherein the container and each cap are made of ceramic material and the furnace comprises a microwave generator.

14. A method for treating a portion of a ferrous alloy tube having a width, a thickness and a length by diffusion alloying, which method comprises:

(a) providing a container having:
  (i) at least one open end;
  (ii) a width that is greater than the width of the portion of the tube to be treated;
  (iii) a thickness that is greater than the thickness of the portion of the tube to be treated; and
  (iv) a depth that is greater than the length of the portion of the metal component to be treated;

(b) placing the portion of the tube to be treated in the container while allowing a portion of the tube that is not to be treated to protrude from the container;

(c) placing a heat-activated alloying powder in the container around the portion of the tube to be treated in a layer that extends along the length of the portion of the tube to be treated;

(d) placing a non-oxidizing powder in the container adjacent to the alloying powder and around the tube in a layer that extends to an open end of the container;

(e) providing a cap for each open end of the container, which cap is adapted to seal the container around the tube except for gases which are produced in diffusion alloying;

(f) providing a furnace that is adapted to heat the portion of the tube to be treated to activate the alloying powder;

(g) placing the container with the portion of the tube to be treated therein in the furnace;

(h) operating the furnace to heat the portion of the tube in the container to a temperature and for a time sufficient to cause diffusion alloying of the portion of the tube to be treated by the alloying powder.

15. The method of claim 14 which is adapted for treating an end of a tube, which method includes placing a cap on the end of the tube to be treated prior to placing the portion of the tube to be treated in the container.

16. The method of claim 14 which includes providing an alloying powder comprising about 30% to about 45% by weight chromium, ferrochromium or a mixture of chromium and ferrochromium powder, about 45% to about 65% by weight alumina powder, and about 3% to about 8% by weight $NH_4Cl$ powder.

17. The method of claim 14 which includes providing a non-oxidizing powder comprising about 97% by weight alumina powder, and about 3% by weight $NH_4Cl$ powder.

18. The method of claim 14 which includes the following steps instead of the corresponding steps of claim 14:

(f) providing a furnace that is adapted to receive a portion of the container that includes the portion of the tube to be treated;

(g) placing a portion of the container with the portion of the tube to be treated therein in the furnace so that each capped end of the container extends out of the furnace a distance that is selected to prevent a portion of the tube that extends out of the capped end of the container from reaching a predetermined critical temperature when the furnace is operated to heat the portion of the container therein;

(h) operating the furnace to heat the portion of the container therein to a temperature and for a time sufficient to cause diffusion alloying of the portion of the tube to be treated by the alloying powder.

19. The method of claim 18 wherein the predetermined critical temperature is about 300° F. and the distance that is selected to prevent a portion of the tube that extends out of the capped end of the container from reaching said critical temperature is within the range of about 4 to about 12 inches.

* * * * *